United States Patent [19]

Castricum

[11] Patent Number: 4,567,742

[45] Date of Patent: Feb. 4, 1986

[54] RIBBED SPIRAL PIPE PRODUCING MACHINE

[75] Inventor: Wilhelmus P. H. Castricum, Rolling Meadows, Ill.

[73] Assignee: Spiro America Inc., Wheeling, Ill.

[21] Appl. No.: 569,752

[22] Filed: Jan. 10, 1984

[51] Int. Cl.[4] ..... B21C 37/12

[52] U.S. Cl. ..... 72/50

[58] Field of Search ..... 72/49, 50, 137, 177, 72/180, 181; 228/17.7, 145

[56] References Cited

U.S. PATENT DOCUMENTS

| | | | |
|---|---|---|---|
| 3,132,616 | 5/1964 | Hale et al. | 113/35 |
| 3,220,234 | 11/1965 | Harper | 72/50 |
| 3,606,779 | 9/1971 | Parma | 72/49 |
| 3,982,414 | 9/1976 | Anderson | 72/50 |
| 4,244,202 | 1/1981 | Anderson et al. | 72/49 |

OTHER PUBLICATIONS

Finnish patent application No. 344/71-Oy Nokia AB: translation of claims and figures.

United McGill "Uni-Rib" advertisement.

Operation Instructions, Spiro Tubeformer 700.

Operation Instructions, Spiro Tubeformer MR.

*Primary Examiner*—E. Michael Combs

*Attorney, Agent, or Firm*—Willian Brinks Olds Hofer Gilson & Lione Ltd.

[57] ABSTRACT

An apparatus for producing multiple ribbed, spiral seamed pipe from a metal strip thinner than 29 gauge is disclosed. The apparatus includes the conventional elements of a frame, a drive roller for feeding the strip through the frame, a flange roller and folding finger for bending the outer edges of the metal strip, a forming head for forming the strip into a pipe so that the outer edges of the strip mate, and a clinching roller and contra roller for compressing the mated edges to produce a spiral seam. The present invention improves this conventional apparatus by providing only two pairs of edge forming roller assemblies that cooperate to bend the left edge of the strip perpendicular to the strip, and the right edge of the strip into an upward facing, V-shaped channel with its outer edge perpendicular with respect to the strip. Five pairs of corrugation rollers are mounted on the frame adjacent to the edge forming roller assemblies. These corrugation rollers cooperate to form three continuous, openchannel corrugation grooves in the metal strip. Each succeeding corrugation roller pair forms the corrugation grooves deeper and narrower than the preceding pair. Three pairs of squeezer assemblies are mounted in the frame adjacent to the corrugation roller means to squeeze together the sides of the corrugation grooves to produce three parallel support ribs for the pipe.

15 Claims, 16 Drawing Figures

FIG. 8a
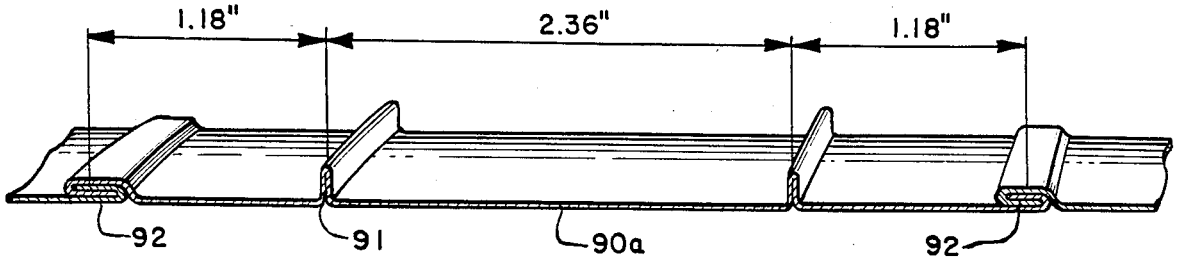
FIG. 8b
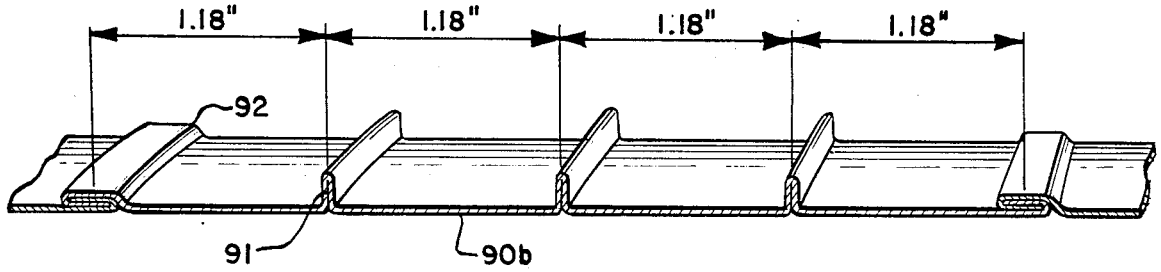
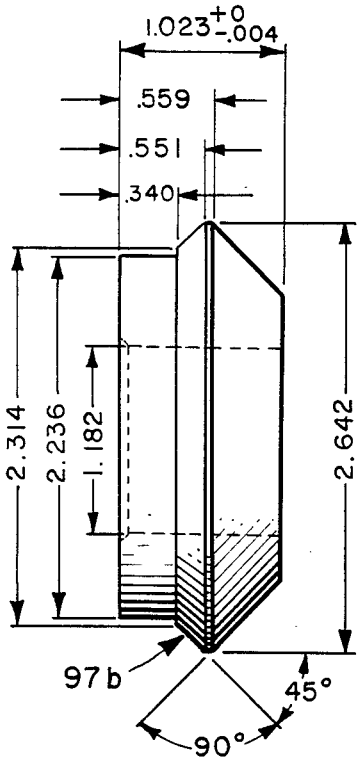
FIG. 9a
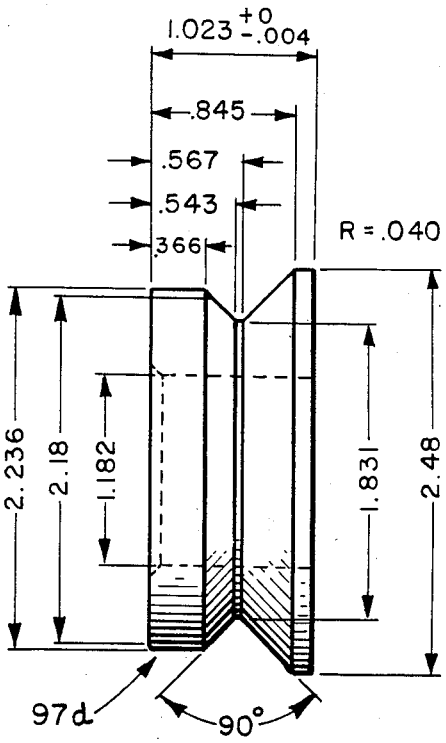
FIG. 9b
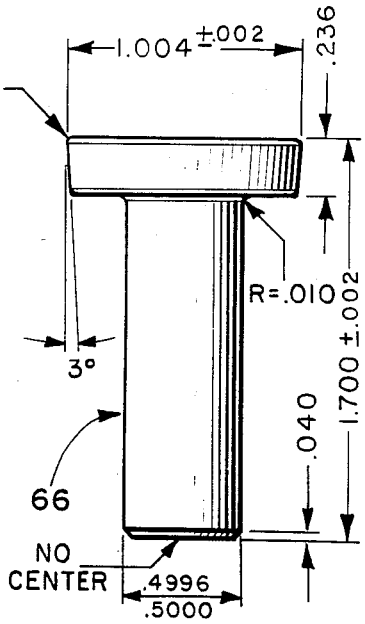
FIG. 10

RIBBED SPIRAL PIPE PRODUCING MACHINE

BACKGROUND AND SUMMARY OF THE INVENTION

This invention generally relates to an apparatus for producing ribbed, spiral seamed pipes, particularly pipes made from 30 gauge steel or thinner with multiple ribs between the seams.

Spiral seamed pipes made from strips of sheet metal are widely used to transport fluids. For example, these pipes are frequently used to transport air to ventilate, heat or cool buildings. In this application, as well as others, it is desired that the pipe produced is strong, lightweight and inexpensive, and provides minimal resistance to fluid flow. The pipe must be sufficiently strong to maintain rigidity over long expanses and against pressure from external forces. Any aberration in the uniformity of the inner pipe surface, such as a bend or dent, increases the resistance to fluid flow through the pipe. It is desirable for the pipe to be lightweight so that less manpower is required to carry and install it. Two ways to reduce weight are to use a lighter metal and less of it. The type and amount of metal also affects the cost of the pipe and usually its strength.

One approach to strengthing a spiral pipe is shown in U.S. Pat. No. 3,132,616 to Hale et al. This patent discloses an apparatus which is intended to form fluid-tight spiral pipes from band stock. This patent teaches the formation of two open-channel corrugation grooves in the band stock which serve to stiffen the pipes. The grooves are formed as the band stock passes between two pairs of forming rollers before being shaped into a pipe. Each pair of rollers comprises a lower roller with two annular ribs protruding from its surface and a corresponding upper roller with two annular grooves formed in its surface, each rib fitting into a corresponding groove. As the band passes between the first set of rollers, the ribs and grooves cooperate to form two longitudinal, parallel, open-channel grooves of a first diameter in the band. The second pair of rollers makes the grooves deeper and narrower as its ribs are higher and grooves are deeper.

While these open-channel grooves improve the rigidity of the pipe, they also have some shortcomings. They create turbulence within the fluid flowing along the walls of the pipe. This turbulence results in higher friction loss and noise in the fluid flow.

Finnish Patent Application No. 344/71 to OY NOKIA AB, which was laid open to inspection in 1980, discloses an alternate approach to strengthening pipes made from a lighter metal (typically 24–26 gauge). The machine disclosed in this reference produces a spiral seamed pipe with a single, loop-shaped ridge between the seams. This ridge is produced by three pairs of rollers which form an open-channel groove in the middle of the band and a fourth set of rollers which pinches the sides of the groove together at its base to form the hollow ridge. The ridge stiffens the pipe more than an open-channel groove so that lighter metals can be used to make a pipe. In addition, closing the base of the ridge makes the inner surface of the pipe smoother, thereby reducing frictional resistance to fluid flow through the pipe.

Notwithstanding these advantages, the pipes produced by the Finnish Machine also have certain drawbacks. Conventional thinking dictates that the higher the ridge the greater the strength. In applications requiring strong pipes, a high ridge would be employed. However, in some applications it has been found that the top of the ridge folds over and collapses before the full strength of the ridge is utilized. Thus, the material that comprises the top of the ridge adds relatively little additional strength to the pipe. This problem is exacerbated with lighter metals (e.g. thinner than 26 gauge). In addition, these pipes are flexible over long expenses as the ridges tend to separate at their bases. Another drawback is that, fluid is able to penetrate and move within the ridge cavity at multiple points along the length of the pipe. This causes a whistling sound as the fluid travels through this ridge. Also, where the pipe is cut off, the ends of these ridges are open, thereby allowing the fluid in the ridges to escape from the system. If this penetration is to be positively prevented, the base of the ridges must be sealed (e.g., by welding) as well as the open ends of the ridges where the pipe is cut off.

The present invention responds to the drawbacks and limitations of the prior art by providing an improvement in a spiral pipe producing apparatus for producing triple ribbed, spiral seamed pipe. The apparatus includes at least three pairs of corrugation rollers. A first pair of corrugation rollers has a center rib and two outer ribs which cooperate with a center groove and two outer grooves for forming three parallel corrugation grooves in the metal strip. A second pair of corrugation rollers has a center rib and two outer ribs which cooperate with a center groove and two outer grooves for forming the corrugation grooves in the metal strip deeper and narrower. The outer ribs and outer grooves of the second corrugation roller pair are inwardly displaced relative to the outer ribs and outer grooves of the first corrugation roller pair. A third pair of corrugation rollers has a center rib and two outer ribs which cooperate with a center groove and two outer grooves for forming the corrugation grooves in the metal strip deeper and narrower. The outer ribs and outer grooves of the third corrugation roller pair are inwardly displaced relative to the outer ribs and outer grooves of the second corrugation roller pair. Squeezer means then squeeze together the sides of the corrugation grooves to produce three parallel ribs in the metal strip.

In the preferred embodiment, two or more ribs are formed between the seams. Also, no more than ten pairs of rollers or squeezers are mounted in the apparatus so that pipes of different metal gauges and rib configurations can be made on the same machine by merely interchanging the various rollers and squeezers. The preferred embodiment employs only two edge forming roller assembly pairs to bend the outer edges of the strip into a conventional configuration that is capable of producing a very tight lockseam. The first pair of rollers bends the left edge of the strip downwardly at an angle less than 45° and the right-edge into a V-shaped channel. The second roller pair further bends the left edge downwardly so that it is perpendicular to the strip, and bends the outer edge of the V-shaped channel upwardly so that it is perpendicular with respect to the strip. Five pairs of corrugation rollers are used to form the grooves progressively deeper and narrower.

In the present invention, the rollers and squeezers cooperate to produce a ribbed pipe that overcomes many of the disadvantages associated with pipes produced by prior art machines. First, the present invention can produce spiral pipes from 30 gauge metal or lighter (e.g. 33 gauge) that is as strong, or stronger, than pipes produced from conventional machines and provides low resistance to fluid flow. The thinner gauge metal weighs and costs less than the materials that are commonly used in conventional machines. The plurality of closed ribs between the seams provides greater strength, and the strength increases as the number of ribs increases. In fact, it is very difficult to make spiral pipe from 33 gauge metal without the ribs of this invention because the metal strip is so weak that it tends to collapse in the forming head. The multiple rib configuration also provides greater strength with less material since the ribs do not have to be as high. Moreover, the smaller rib height permits the pipes to fit within smaller spaces, and may provide a more pleasing aesthetic effect. Another advantage is that the ribs are preferably squeezed together (as opposed to hollow) so that fluid does not travel within the ribs. Thus, the ends of the ribs do not have to be sealed when the end of the pipe is cut off. All these advantages can be realized using one machine which accommodates 10 or fewer pairs of various combinations of rollers and squeezers.

These and other advantages of the present invention will be apparent from the following description of the preferred embodiment, annexed drawings, and appended claims.

BRIEF DESCRIPTION OF THE DRAWINGS

FIGS. 8*a* and 8*b* are partial-sectional views of the two-rib and three-rib pipes, respectively, that may be produced with the present invention;

FIGS. 9*a* and 9*b* are elevation views of two lockseam rollers of FIGS. 3*a* and 3*b;*

FIG. 10 is an elevation view of the squeezer roller of FIG. 4; and

DETAILED DESCRIPTION OF THE PREFERRED EMBODIMENTS

The principles of this invention are particularly useful when embodied in a ribbed spiral seamed pipe producing apparatus such as illustrated in the Figures, generally indicated by the numeral 10.

Figure 1:
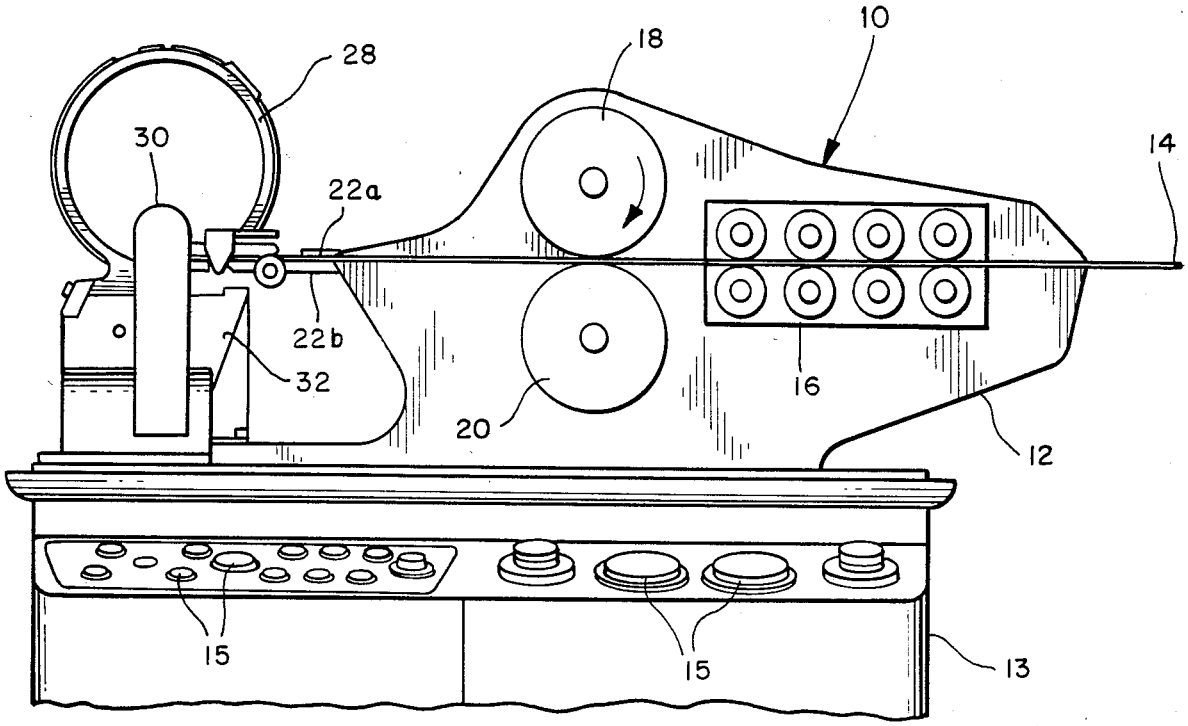
FIG. 1 is a side elevation view of a presently preferred embodiment of the ribbed spiral pipe producing apparatus of the present invention.
Figure 2:
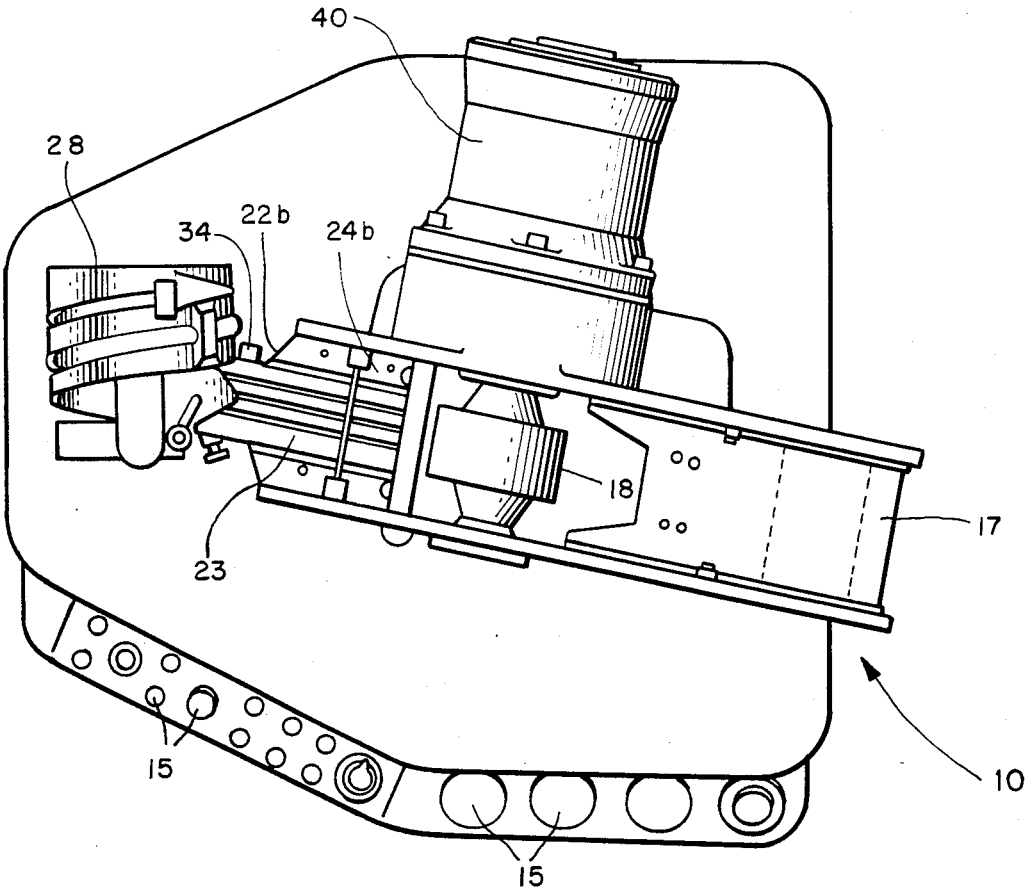
FIG. 2 is a plan view of the ribbed spiral pipe producing apparatus of FIG. 1.

Referring to FIGS. 1 and 2, the spiral seamed pipe producing apparatus 10 includes a frame 12 and an electrical cabinet 13. A plurality of gauges, switches, valves, and buttons 15 are located on the electrical cabinet 13 for controlling and monitoring the operation of the apparatus in a conventional manner. A roller housing 16, which contains a plurality of forming rollers (described below), is mounted to a base 17 with standard fastening screws.

An upper drive roller 18 and a lower drive roller 20 are rotatably mounted therein the frame 12 adjacent the roller housing 16. The upper drive roller 18 is positively driven under hydraulic pressure by a hydraulic motor 40 in a clockwise direction. The upper drive roller 18 pulls a metal strip 14 into the frame 12 and feeds it through the frame between the forming rollers in the roller housing 16 and over the lower drive roller 20. These two drive rollers operate in a conventional manner with two exceptions. First, for 30 and 33 gauge metal strips, the hydraulic pressure on the upper drive roller should be reduced to 70–140 p.s.i. Second, the surface of the lower drive roller 20 has grooves to accommodate the ribs that are impressed into the strip 14 in the roller housing 16.

The frame is also fitted with four standard guide plates—lower and upper front guide plates 22*a, b* and lower and upper rear guide plates 24*a, b.* These guide plates include several modifications to accommodate ribbed, thin gauge metal. First, the inlays (not shown) fixed between the upper and lower guide plates which allow the strip to pass between the plates are thinner than normal. Second, the lower guide plates 22*b* and 24*b* contain grooves 23 to accommodate the ribs that are formed in the metal strip 14 in the roller housing 16. The grooves 23 should be as deep as the highest rib that will be produced for any pipe made with the machine. (The same is true for the depth of the grooves cut in the lower drive roller 20, forming head 28, and lower corrugation rollers 47*b*–51*b*.) Third, the support arm 30 should press the plates down about $\frac{1}{8}''$ less when a 33 gauge steel strip is used.

In the preferred embodiment of the present invention 33 gauge steel is used, although the present invention also provides new advances and unexpected results over the prior art with 30 gauge metal and thicker. The gauge number refers to a standard measure of metal thickness which is immediately recognized and understood by those skilled in the art in the United States. When 33 gauge metal strip is used to produce triple ribbed pipe, the starting strip should be wider than normal (e.g. 153 mm) because more material is lost in the ribs (approx. 33 mm).

Figure 3A:
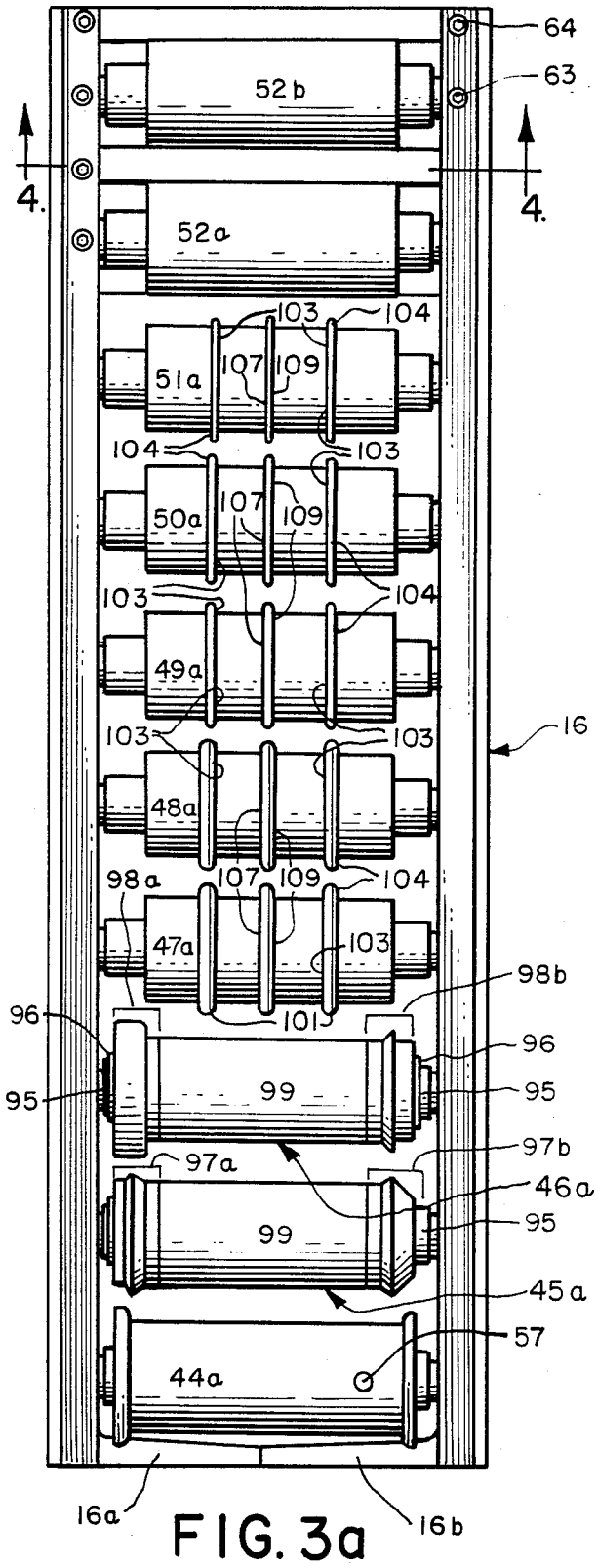
FIGS. 3*a* and 3*b* are plan views of the upper rollers, and lower rollers and squeezing means, respectively, of the preferred embodiment of FIG. 1 with the profile of the strip as it appears after it passes the first and second pair of edge forming roller assemblies, respectively.
Figure 3B:
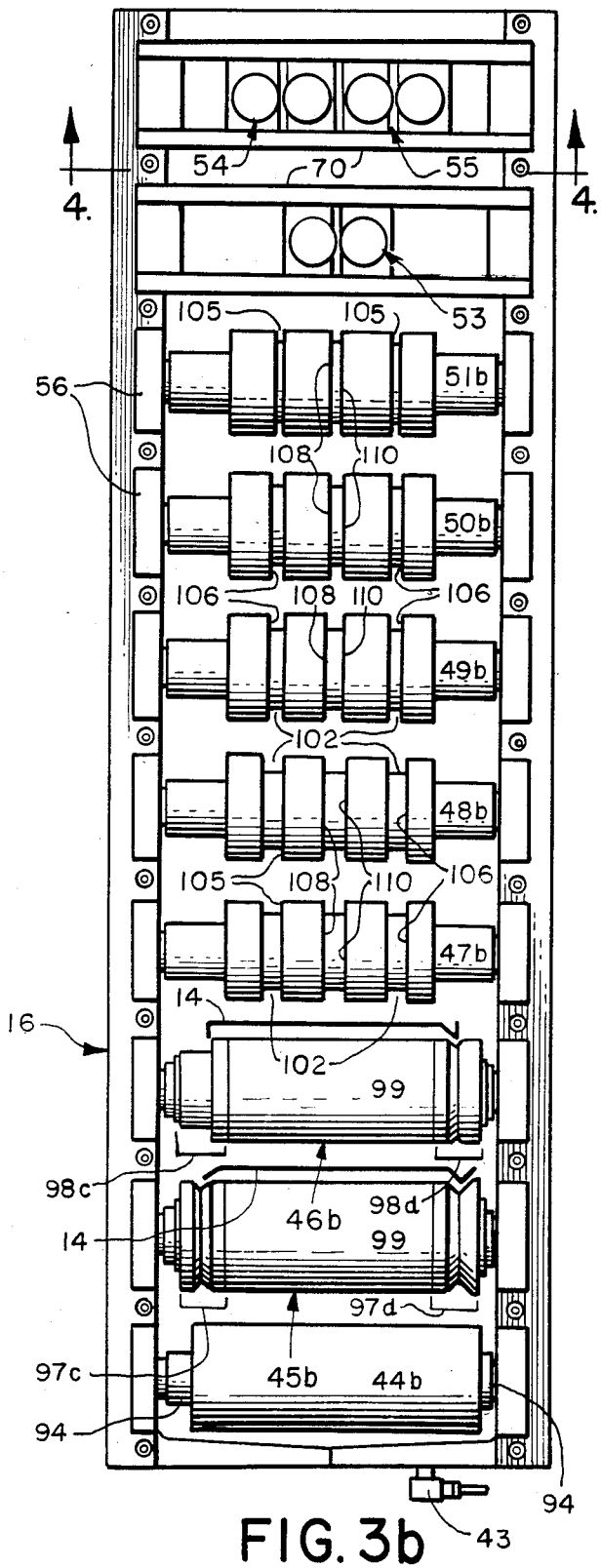

FIGS. 3A and 3B show the preferred embodiment of the forming rollers positioned in the roller housing 16. FIG. 3A illustrates ten upper rollers 44*a*–52*a* and 52*b* positioned adjacent each other in the roller housing 16, and FIG. 3B shows eight lower rollers 44*b*–51*b* positioned immediately below the first eight upper rollers 44*a*–51*a* and two rows of squeezer assemblies 53–55 placed immediately below the last two upper rollers 52*a* and *b*. As the metal strip 14 is fed between the upper rollers 44*a*–52*a* and 52*b* and the lower rollers 44*b*–51*b* and squeezers 53–55, the rollers and squeezers cooperate to align and guide the metal strip 14 through the roller housing 16, bend the outer edges of the strip 14 into predetermined shapes, form three continuous, parallel open-channel corrugation grooves into the strip, and squeeze the grooves together to form support ribs. In the preferred embodiment illustrated, a three rib pipe may be produced from 33 gauge steel.

The lead-in alignment rollers 44*a,b* align the strip 14 as it is pulled into the roller housing 16. These rollers are mounted on alignment roller shafts 94 so that they slide laterally on the shafts. The upper alignment roller 44*a* is fixed into position to get the proper alignment of the strip edges and the length of the strip flanges by a set screw 57. The upper alignment roller 44*a* is wider than usual to accommodate a 153 mm wide, 33 gauge steel strip. A conventional lubricant is supplied in known fashion to the lower alignment roller 44*b* via an inlet fixture 43. Only the alignment rollers are lubricated because they are subject to the most friction.

Two pairs of upper and lower edge forming roller assemblies 45*a,b* and 46*a,b* are positioned adjacent the alignment rollers 44*a* and *b*. Each edge forming roller assembly is comprised of two lockseam rollers 97*a–d* or 98*a–d* mounted on opposite ends of a standard spacer roller 99 that is integral with a standard edge roller shaft 95. The edge roller shaft 95 is the same as an alignment roller shaft 94, except the former also includes two annular recesses to hold the security rings 96 that keep the lockseam rollers in place.

These two pairs of roller assemblies cooperate to maintain the alignment of the strip as it is fed through the roller housing 16 and to simultaneously bend the outer edges of the strip 14 into flanges of predetermined shapes. The particular shapes formed in the outer edges of the strip 14 by the edge roller assemblies 45*a,b* and 46*a,b*, respectively, are illustrated in FIG. 3B. The first left lockseam roller pair 97*a,c* bends the left edge of the strip downwardly at an angle less than 45° to produce a strip flange, and the right lockseam roller pair 97*b,d* bends the right edge into an upward facing, V-shaped strip channel. The particular height of the flange and channel are the same as those used in the art for 26 and 28 gauge metal. The dimensions (in inches) of the right lockseam rollers 97*b* and *d* are shown in FIGS. 9*a* and *b*, respectively. The second left lockseam roller pair 98*a,c* further bends the left strip flange downwardly so that it is perpendicular to the flat surface of the strip 14, and the second right lockseam pair 98*b,d* bends the outer edge of the V-shaped channel upwardly so that it is perpendicular with respect to the flat surface of the strip 14. The shapes of the outer edges of the strip 14 shown above the lower edge roller assembly 46*b* are recognized in the art as desirable for producing a tight spiral seam.

Five pairs of corrugation rollers 47*a,b*–51*a,b* are positioned adjacent the edge forming roller assemblies 45*a,b* and 46*a,b* in the roller housing 16. These rollers are integral with their respective shafts (i.e. uni-body construction). Each upper corrugation roller contains three annular ribs 101 protruding from its surface, and each lower corrugation roller has three annular grooves 102 cut into its surface. The ribs on each upper corrugation roller fit into the grooves of the corresponding lower corrugation roller. As the metal strip 14 is pulled between the upper and lower corrugation rollers, the ribs 101 and grooves 102 cooperate to form three continuous, longitudinal, open-channel corrugation grooves in the strip 14.

The first pair of corrugation rollers 47*a* and *b* and the second pair of corrugation rollers 48*a* and *b* are identical. That is, their corresponding ribs 101 are exactly the same height and width, and their corresponding grooves 102 are the same depth and width. The second corrugation roller pair 48*a,b*, however, has approximately 1/32" less clearance between its upper and lower rollers so that it forms the corrugation grooves deeper and narrower than the first corrugation roller pair 47*a,b*. The third and fourth corrugation roller pairs 49*a,b* and 50*a,b* are also identical, with the fourth pair having approximately 1/32" less clearance between its upper and lower rollers than the third pair. However, on the third and fourth roller pairs 49*a,b* and 50*a,b* the ribs 101 are higher and narrower and the grooves 102 are deeper and narrower than those of the preceding roller pairs 47*a,b* and 48*a,b*. The ribs 101 and grooves 102 on the fifth pair of corrugation rollers 51*a,b* are narrower and higher than the ribs 101 and grooves 102 on the third and fourth roller pairs 49*a,b* and 50*a,b*. Accordingly, the last three pairs of corrugation rollers cooperate with the first two pairs of corrugation rollers to gradually form the corrugation grooves in the metal strip 14 deeper and narrower.

It is preferred that the ribs 101 and grooves 102 on the corrugation roller pairs 47–51 are not centered on each roller but rather are slightly offset to the right. This is necessary to center the support ribs on the outside of the pipe between the lockseams since the lockseam is folded over when it is formed. This rib spacing arrangement is desired for aesthetic purposes only.

It is also preferred that the inner rib edges 103 and the inner groove edges 105 of the corrugation rollers are in a straight line. The outer rib edges 104 and the outer groove edges 106 of the third and fourth pairs of corrugation rollers 49*a,b* and 50*a,b* are slightly displaced towards the center of the rollers with respect to the outer rib edges 104 and the outer groove edges 106 of the first and second pair of corrugation rollers 47*a,b* and 48*a,b*. Both the left center rib edges 107 right center rib edges 109 the left center groove edges 108 and the right center groove edges 110 of the third and fourth pair of corrugation rollers 49*a,b* and 50*a,b* are slightly displaced to the of the first and second pair of corrugation rollers 47*a,b* and 48*a,b*. In similar fashion, the outer rib edges 104 and the outer groove edges 106 of the fifth corrugation roller pair 51*a,b* are displaced toward the center of the roller with respect to the third and fourth roller pairs 49*a,b* and 50*a,b*. Also, the center rib edges 107 and 109 and center groove edges 108 and 110 of the fifth corrugation rollers 51*a,b* are slightly displaced towards the center of these rollers relative to the center ribs and grooves of the third and fourth corrugation roller pairs 49*a,b* and 50*a,b*. The outer rib edges and groove edges are displaced in this manner to squeeze more material for the corrugation groove from the outside of the strip 14 rather than the inside because it is harder to stretch material from the inside.

When using 33 gauge steel to produce 3-rib spiral pipe, it is preferred that the five pairs of corrugation rollers 47*a,b*–51*a,b* are made of induction hardened steel (58° Rockwell C) because they are subject to more friction than usual. More 33 gauge steel is lost in forming the corrugation grooves which causes more sliding between the corrugation rollers, and hence friction. The other rollers in the roller housing 16 may be made of conventional materials.

It is important to have more than three, and preferably five, pairs of corrugation rollers when forming corrugation grooves in 30–33 gauge steel strip. Otherwise, this thin metal is abruptly stretched in the middle which often causes fractures, wrinkles, and incorrect flange and channel sizes.

A first squeezer assembly 53 and its associated support roller 52*a* is positioned in the roller housing 16 adjacent the fifth pair of corrugation rollers 51*a,b*. This squeezer assembly produces a center support rib by squeezing together the sides of the center corrugation groove in the metal strip 14. Two additional squeezer assemblies 54 and 55 are positioned side-by-side in the roller housing 16 adjacent to the squeezer assembly 53. These two squeezer assemblies 54 and 55 push together the sides of the two outer corrugation grooves to produce two support ribs, each parallel and adjacent to the center support rib.

Figure 4:
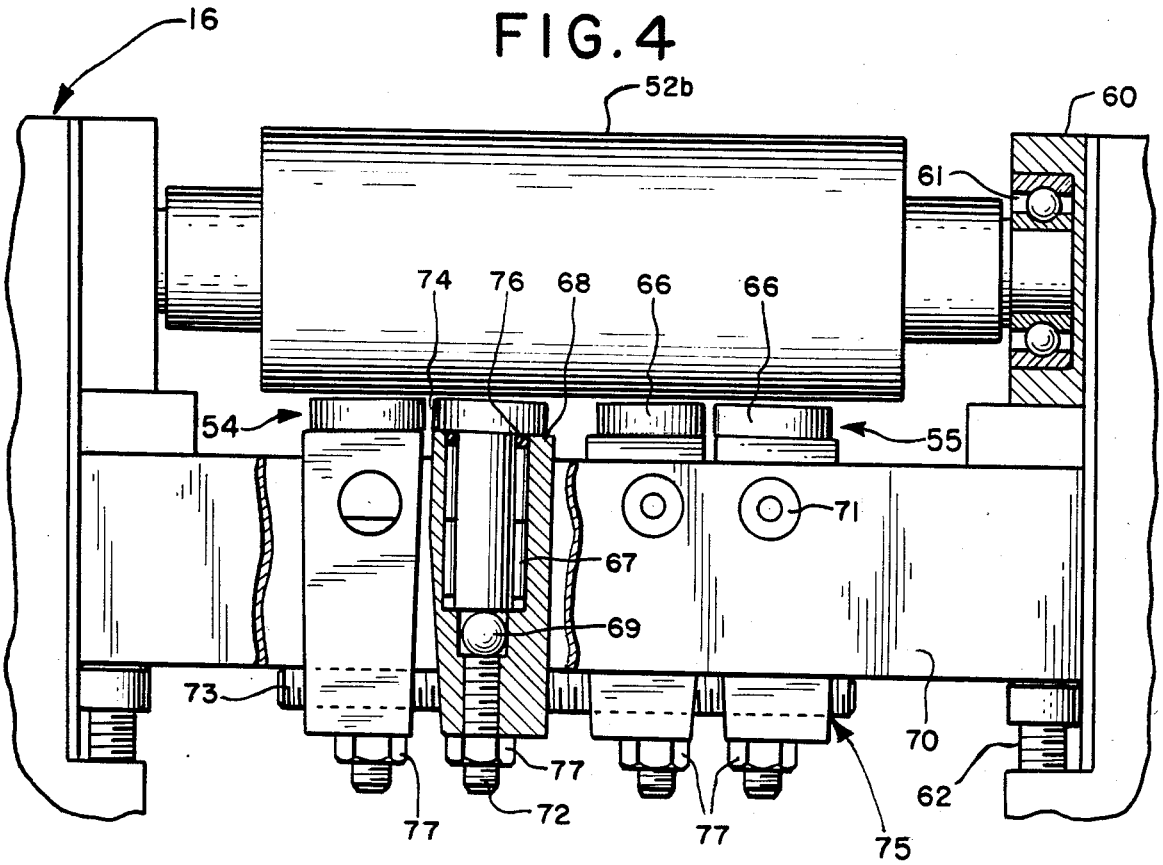
FIG. 4 is an elevation view taken along lines 4—4 of FIGS. 3*a* and 3*b;*

Referring now to FIG. 4, it is seen that two squeezer assemblies 54 and 55 are mounted side-by-side on a block 70 that fits within one compartment 56 of the roller housing 16. Each squeezer assembly 53–55 includes a pair of horizontally disposed squeezer rollers 66 which squeeze both sides of the outer corrugation grooves together. The entirety of both sides of the grooves are squeezed so that the rib channel is closed. The squeezer rollers 66 are supported within a housing 68 by needle bearings 67 and a ball 69 which functions like a ball bearing. An oil seal 76 is provided in the top of the housing 68 to keep out lubricants that may be present on the metal strip 14. Each housing 68 is mounted in the block 70 via a swivel pin pivot 71 that allows the squeezer rollers 66 to accommodate variations in the corrugation grooves. Each squeezer assembly also includes a vertical set screw 72 and a horizontal set screw 73. The vertical set screw allows adjustment of the height of the squeezer roller 66 to accept different gauge metals. For example, a higher setting is necessary for a light gauge metal. The horizontal set screw 73 is used to adjust the clearance 74 between a pair of squeezer rollers 66. For example, a wider type clearance is necessary for a heavy gauge metal. Nutlock 75, a liquid glue, is used to maintain the adjustment of the horizontal set screw 73, and a nut 77 maintains the adjustment of the vertical set screw 72. A support roller **52*b* keeps the metal strip 14 pushed down as it passes over the squeezer rollers 66. The important dimensions and tolerances (in inches) of a roller squeezer 66 for 33 gauge metal is shown in FIG. 10. For 30 gauge metal, the top diameter of the squeezer should be 0.996" and the length should be 1.696". It is preferred to have separate squeezer rollers 66 for 33 and 30 gauge metal rather than adjusting the set screws 72 and 73** whenever the metal gauge is changed.

Figure 5:
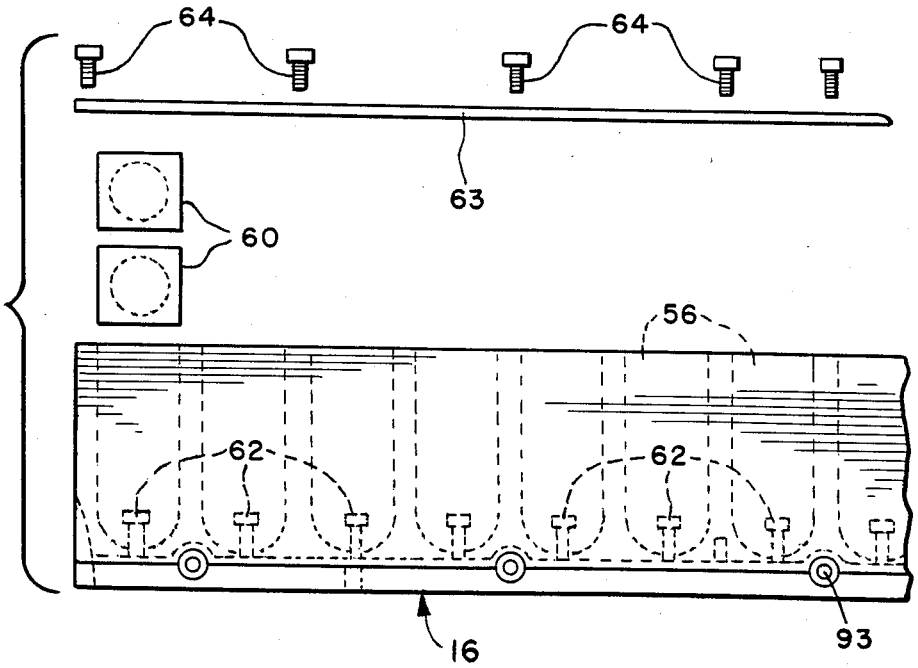
FIG. 5 is an exploded side view of the parts of the roller housing of FIGS. 3*a* and 3*b;*
Figure 6:
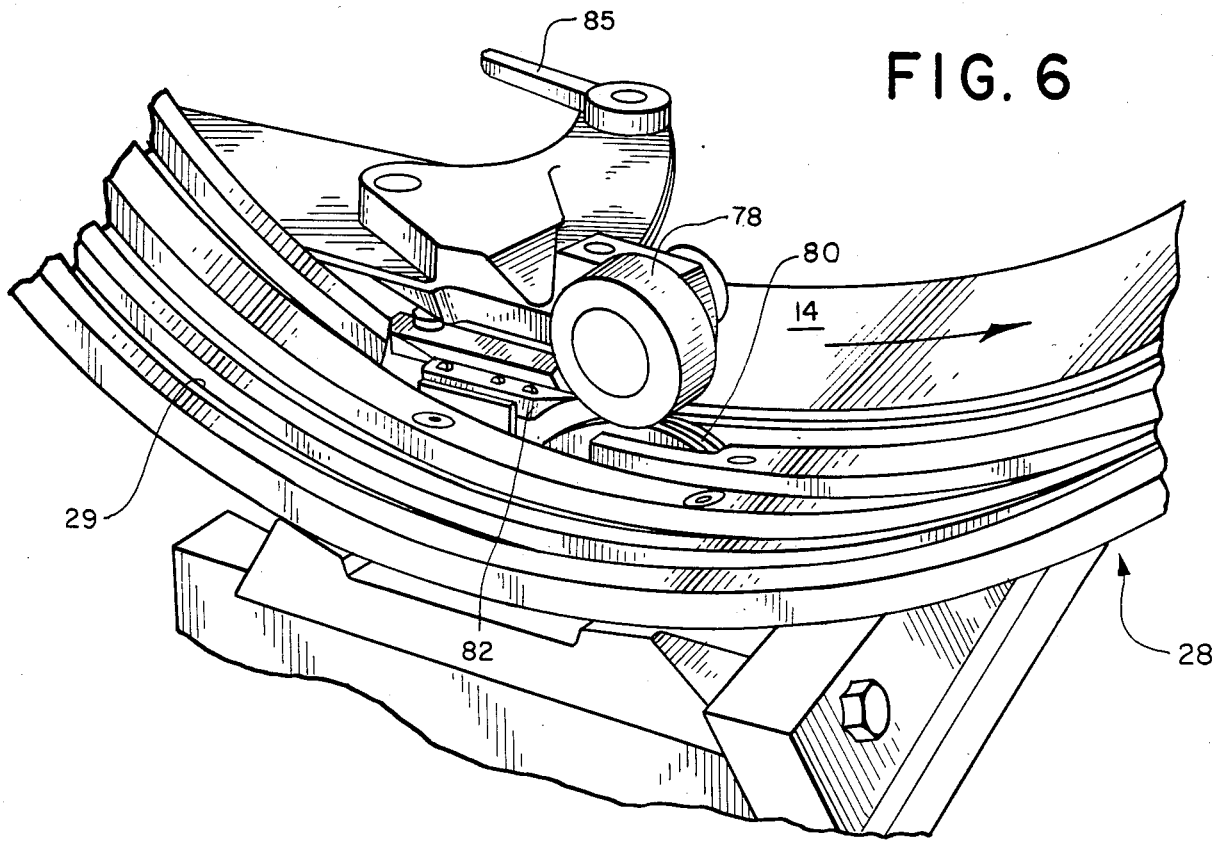
FIG. 6 is a rear perspective view of the forming head of FIG. 1.
Figure 7:
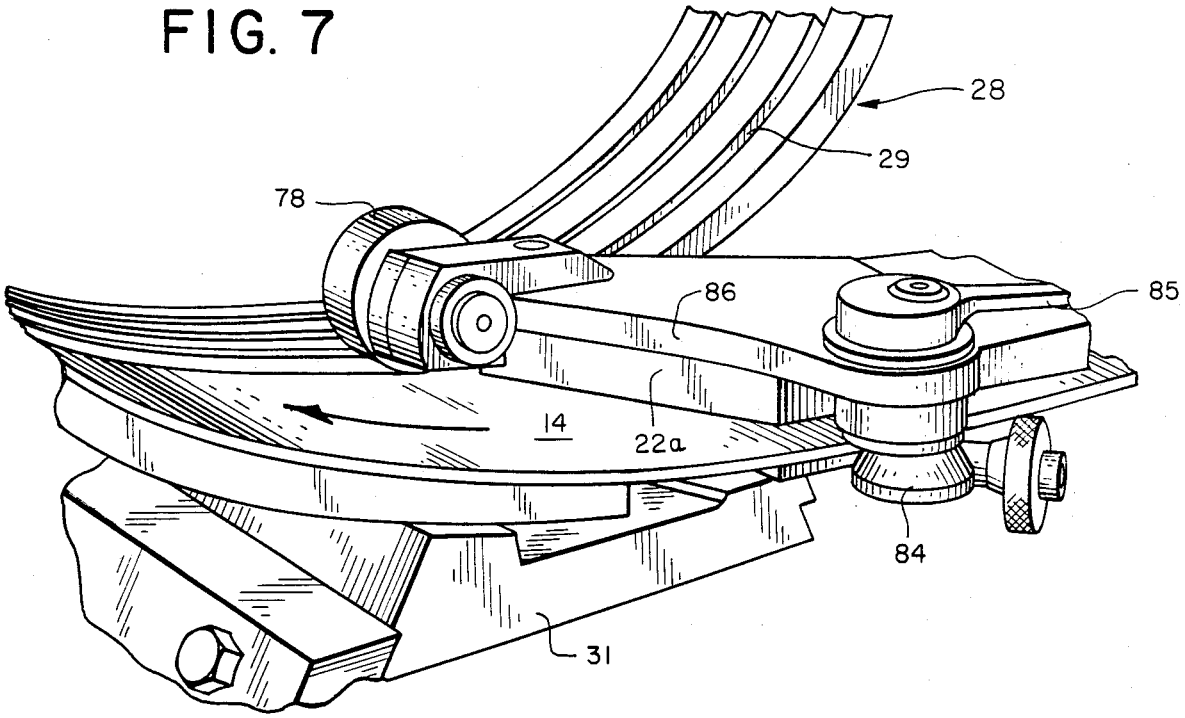
FIG. 7 is a front perspective view of the forming head of FIG. 1.
Figure 11A:
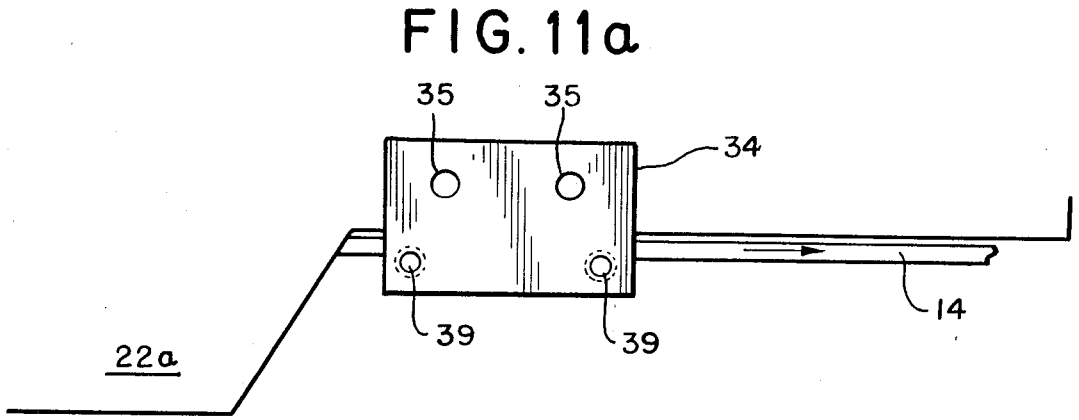
FIGS. 11*a, b,* and *c* are plan, side elevation, and front elevation views, respectively, of the channel straightener in FIG. 2.
Figure 11B:
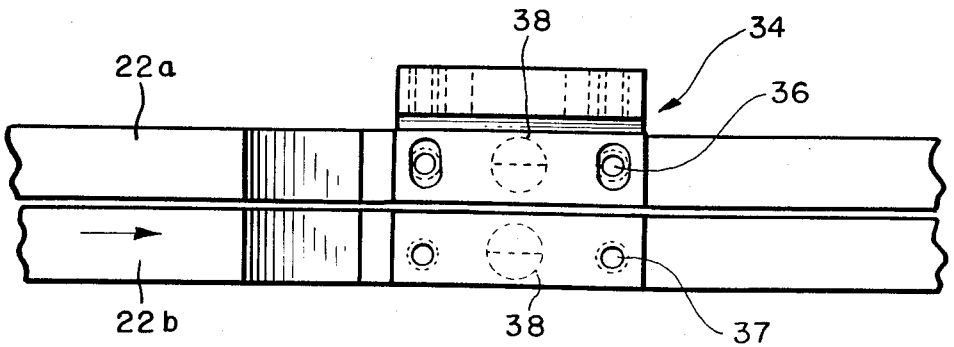
Figure 11C:
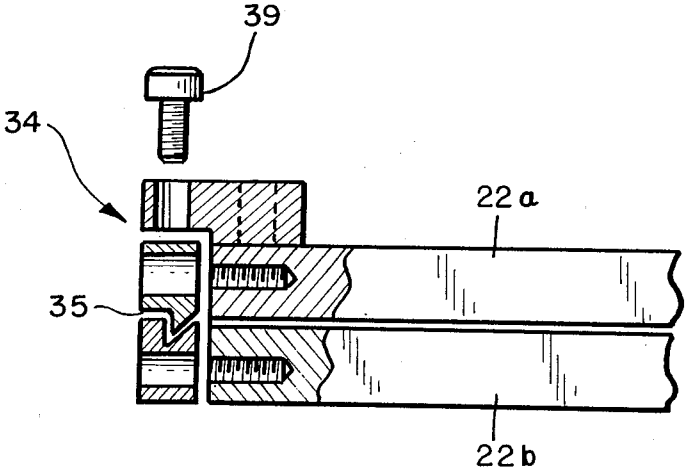

FIG. 5 shows eight of the ten compartment slots 56 in roller housing 16. The roller housing 16 is actually comprised of two halves **16*a* and 16*b* which are connected together by bolts 93. This ten compartment roller housing is needed to produce 3-rib, 33 gauge steel spiral seam pipe, and is also used for every other type of ribbed spiral seamed pipe. Each compartment accommodates one pair of alignment rollers, edge forming roller assemblies, corrugation rollers, or squeezer assemblies and associated support roller. Each type of roller is mounted in an end of plate 60 between bearings 61. The squeezer assembly blocks 70 are the same size as the end plates 60. The end plates 60 easily slide into the compartments 56. The bottom of each compartment 56 is provided with an adjusting bolt 62 on each side. The adjusting bolts 62 are adjusted to obtain the proper clearance between the upper and lower rollers in the compartment. The roller housing 16 is also provided with a locking strip 63 which is held down to the top of housing 16 by bolts 64. This strip 63 keeps the tops of the second end blocks 60 in each compartment even with the top of the roller housing 16 as the pressure of the metal strip pushes the upper rollers up as it is fed through the roller housing 16**, thereby maintaining the proper clearances between the upper and lower rollers.

Because of the modular design of the roller, housing 16, the edge roller assemblies, corrugation rollers, and squeezing means can be easily interchanged to produce spiral seamed pipe of different gauge metals, strip widths or rib configurations. For example, to produce a double rib, 33 gauge steel pipe, the five upper corrugation rollers would have to be replaced with five two-rib upper corrugation rollers and the first squeezer assembly 53 and its support rollers **52*a* would be removed from the roller housing 16. The lower corrugation rollers do not have to be removed because their center groove will not be used. If a heavier gauge metal or lower rib height is required, one or more pairs of corrugation rollers can be removed and the two pair of preferred edge forming roller assemblies 45*a,b* and 46*a,b* could be replaced with a conventional three pair edge forming roller arrangement. To produce a single rib pipe of 33 gauge stainless steel, the five upper corrugation rollers would have to be replaced with five upper corrugation rollers with only one rib, and the second and third squeezer assemblies 54 and 55 and their support roller 52*b* would have to be removed. Thus, a wide variety of spiral seamed pipes can be produced with the present invention merely by interchanging the corrugation rollers, edge roller assemblies, and squeezer assemblies within the roller housing 16**, instead of using a separate machine for every different type of spiral seamed pipe produced.

FIGS. 1, 2, 6, and 7 illustrate some conventional elements that cooperate in a known manner to form to the 3-ribbed, 33 gauge steel strip exiting the roller housing 16 and guide plates **22*a,b* and 24*a,b* into a spiral seamed pipe. A forming head 28 is integrated with a foot plate 31 which is mounted on a base 32. The base 32 is integrated with the frame 12 and electrical cabinet 13. This standard forming head is modified to include grooves 29** along its inside surface to accommodate the ribs on the strip and resulting pipe.

FIGS. 2 and **11*a–c* shows a channel straightener 34 which is used in the preferred embodiment to straighten any wrinkles that may exist in the right strip channel and to provide a further alignment of the strip 14. The channel straightener 34 is mounted to the front upper guide plate 22*a* via bolts 35 and 36 and to the front lower guide plate 22*b* by bolts 37. The straightener is provided with springs 38 so that the bolts 36 and 37 mount the straightener 34 to the guide plates in a spring loaded fashion to keep the straightener from moving around. A set screw 39 is adjusted to set the clearance 35** in the straightener for the strip channel to pass through.

Between the upper front guide plate **22*a* and the forming head 28, a standard flange roller 84 and its handle 85 are mounted on the roller holder 86. A contra roller 78 is also mounted on the roller holder 86. This contra roller is a standard part that functions in a conventional manner in the present invention, except that it is more curved and positioned approximately 3/16" closer to the flange roller 84. The contra roller should be pushed down by the support arm 30 about ⅛" higher than usual when using 33 gauge metal. A standard clinching roller 80 is shown immediately below the contra roller 78 is FIG. 6. The depth of its groove is smaller in accordance with the conventional principle that it should equal three times the thickness of the metal. Otherwise, this clinching roller operates in a known manner. A folding finger 82 is located immediately before the clinching roller 80 and the contra roller 78. The folding finger 82** is a standard part except that its tip is a little more pointed than usual to prevent it from rubbing the pipe.

The flange roller 84, folding finger 82, forming head 28, clinching roller 80, and contra roller 78, cooperate to produce a tight spiral lockseam and pipe in a conventional manner. That is, the flange roller 84 further bends the strip flange 35°, and the folding finger 82 further bends the outer edge of the V-shaped channel 35°. The bent outer edges of the metal strip 14 (the strip flange and strip channel) are then mated by the forming head 28 so that they interlock and the metal strip 14 forms a pipe. The clinching roller 80 and contra roller 78 compress the mated edges to produce the spiral seam. Furthermore, the folding finger 82, clinching roller 80, the contra roller 78, flange roller 84, as well as the upper alignment roller 44*a*, the angle of the frame 12 and the clearance between the forming rollers in roller housing 16, can be readily adjusted by one skilled in the art using conventional techniques to obtain a perfect lockseam. Those skilled in the art would recognize a perfect lockseam as one in which the strip flange and strip channel interlock so that they completely fill the seam. Examples of some adjustments that should be made when using 33 gauge metal are slightly raising the height of the contra roller 78 to lessen the pressure on it and reducing the angle of the frame to minimize the occurrence of buckles in the strip 14. Also, if a standard runoff table is used in conjunction with the present invention, its rollers should be lowered to compensate for the rib height.

FIG. 8 illustrates two different types of novel multiple rib spiral seamed pipe that can be produced with the present invention. The two-rib pipe 90*a* provides more space between the support ribs 91 in which take-out pipes may be tapped. For aesthetic reasons, it is preferred that the center of the ribs 91 in the two-rib pipe 90*a* are spaced equidistantly both between and across the seams 92. The three-rib pipe 90*b* produces an exceptionally strong pipe. The ribs 91 of the three-rib pipe 90*b* are preferably spaced equidistantly between the seams. Across the seams 92, the spacing should be double the space between the ribs.

In operation, the apparatus of the present invention operates as follows. First, the outer edges of the leading edge of the strip 14 are trimmed to make it possible to push the leading edge of the strip freely past the lockseam and corrugation rollers in the roller housing 16. The left edge is cut back 1.875" for a distance of 2'6". A first ¾" finger of metal is left intact. A ¾" spline of metal is cut from the strip adjacent the first finger. A second ¾" finger is left intact to the right of the first spline. The remainder of the metal strip to the right of the second finger is then cut off. Thus, the leading edge of the strip should consist of two ¾" fingers 2'6" long. The preferred metal strip 14 is 33 gauge galvanized or stainless steel.

In a conventional fashion, the machine is started, lubricated, and hydraulically driven. If the leading edge of the strip has been inserted between the drive rollers 18 and 20, the machine will start pulling the strip 14 into the frame 12.

As the strip 14 is fed into the roller housing 16, it passes between the upper rollers 44*a*–52*a*,52*b* and the lower rollers 44*b*–51*b* and squeezers 53–55. The alignment rollers 44*a*,*b* align the strip as it enters the roller housing 16. The first pair of edge forming roller assemblies 45*a*,*b* bend the outer edges of the strip into predetermined shapes. The left edge of the strip is bent downwardly at an angle less than 45° to produce a strip flange, and the right edge is formed into an upward facing V-shaped strip channel. The second pair of edge roller assemblies 46*a*,*b* further bend the left strip flange downwardly so that it is perpendicular to the flat surface of the strip 14, and the outer edge of the V-shaped channel upwardly so that it is perpendicular with respect to the flat surface of the strip 14. The ribs 101 and grooves 102 of the first pair of corrugation rollers 47*a*,*b* cooperate to form three corrugation grooves in the strip 14. The ribs 101 and grooves 102 of the succeeding four pairs of corrugation rollers 48*a*,*b*–51*a*,*b* gradually draw the corrugation grooves deeper and narrower.

The side of the corrugation grooves are subsequently pushed together by the squeezer assemblies 53–55 to produce three parallel, closed-channel support ribs. The first squeezer assembly 53 squeezes together the sides of the center corrugation groove. The second and third squeezer assemblies 54 and 55 simultaneously compress the sides of the two outer grooves. The squeezer assemblies 53–55 are adjusted horizontally and vertically by set screws 73 and 72 to accept corrugation grooves produced with different gauge metals, and are pivotally mounted to accommodate aberrations in the corrugation grooves.

The ribbed metal strip is pushed towards the pipe producing area that includes a channel straightener 34, flange roller 84, folding finger 82, clinching roller 80, contra roller 78, and forming head 28. The channel straightener 34 removes wrinkles from the v-shaped strip channel and aligns the strip 14. Except for some minor adjustments to accommodate the 33 gauge metal and ribs, the other, conventional elements cooperate in a known manner to form the ribbed strip into a pipe with a tight spiral lockseam.

The invention described above provides significant advantages over conventional spiral pipe producing machines. First, only two pairs of edge forming roller assemblies are needed to produce the configuration of the metal strip 14 illustrated in FIG. 3B above the lower edge roller assembly 46*b*. This configuration is recognized in the art as capable of producing a tight spiral seam. In conventional spiral pipe machines, three pairs of edge roller assemblies are typically used to bend the strip edges into this configuration. The extra pair of edge roller assemblies is thought to be important to maintain the strip in alignment. For example, the first pair of edge rollers may bend both the right and the left edges of the strip downwardly at an angle less than 45° to produce left and right strip flanges. The ends of both strip flanges are then pinned into alignment against a vertical face of the lower edge roller in similar fashion to that shown in FIG. 3B for the left strip flange produced by the left lockseam rollers 97*a* and *c*. Thus, two guide points are provided for alignment of the metal strips by the first pair of edge forming rollers. The second and third pairs of edge forming rollers cooperate to shape the edges into the configuration shown in FIG. 3*b* above the lower edge roller assembly 46*b*: the left flange perpendicular to the strip and the outer edge of an upward facing, V-shaped channel perpendicular with respect to the strip.

While a three edge forming roller pair arrangement can be used to produce multiple ribbed spiral seamed pipe like the present invention, it requires an extra compartment 56 in the roller housing. In the case of three rib 33 gauge pipe, this would require eleven compartments:

1 for the alignment roller pair, 3 for the edge roller assembly pairs, 5 for the corrugation roller pairs, and 2 for the three squeezer assemblies. This is too many compartments for a conventional machine to accommodate without significant re-design.

Thus, reducing the number of edge roller assemblies allows existing spiral seamed pipe machines to produce three rib 33 gauge pipes without significant structural modifications. Moreover, any other type of metal gauge or rib configurations pipe can be made with the same machine by merely changing the corrugation rollers and squeezer assemblies and making some minor adjustments to some other components of the machine that would be straightforward to one skilled in the art. Moreover, the present invention produces the unexpected result that the accuracy of alignment does not diminish by having only one guide point. A single guide point arrangement with the first edge roller assembly pair 45*a,b* might be expected to be more susceptible than a two guide point arrangement to misalignment problems. Surprisingly, this is not the result when 30 gauge metal or lighter is used.

The preferred embodiment described above is a machine that produces a three ribbed spiral seam pipe from 33 gauge metal. These pipes can have a preferred diameter between 4"–36". However, it should be apparent that the present invention is not limited to that particular metal gauge or any particular rib configuration. On the contrary, the present invention can be advantageously used with a two rib configuration, and possibly a one rib configuration, or with a 30 gauge metal or thinner.

Of course, it should be understood that various changes and modifications to the preferred embodiment described above will be apparent to those skilled in the art. It is intended that the foregoing description be regarded as illustrative rather than limiting, and that it be understood that it is the following claims, including all equivalents, which are intended to define the scope of this invention.

I claim:

1. In an apparatus for producing spiral seamed pipe from a metal strip, including a frame, means for feeding the strip through the frame, means for forming the strip into a pipe so that the outer edges of the strip mate, and means for compressing the mated edges to produce a spiral seam, the improvement comprising:

a first pair of corrugation roller means having a center rib and two outer ribs which cooperate with a center groove and two outer grooves for forming three parallel corrugation grooves in the metal strip;

a second pair of corrugation roller means having a center rib and two outer ribs which cooperate with a center groove and two outer grooves for forming the corrugation grooves in the metal strip deeper and narrower, the outer ribs and outer grooves of the second corrugation roller means being inwardly displaced relative to the the outer ribs and outer grooves of the first corrugation roller means;

a third pair of corrugation roller means having a center rib and two outer ribs which cooperate with a center groove and two outer grooves for forming the corrugation grooves in the metal strip deeper and narrower, the outer ribs and outer grooves of the third corrugation roller means being inwardly displaced relative to the the outer ribs and outer grooves of the second corrugation means; and means for squeezing together the sides of the corrugation grooves to produce three parallel ribs in the metal strip.

2. The improvement of claim 1 wherein a first pair of the edge forming roller means bends a first edge of the strip downwardly at an angle less than 45° and bends a second edge into a v-shaped channel, and a second pair of the edge forming roller means further bends the first edge downwardly so that it is perpendicular to the strip and bends the outer edge of the v-shaped channel upwardly so that it is perpendicular with respect to the strip.

3. The improvement of claim 1 further comprising two pair of edge forming roller means positioned in front of the first corrugation roller means for aligning the strip as it is fed into the frame and for bending the outer edges of the strip into predetermined shapes.

4. The improvement of claim 1 wherein the squeezing means further includes:

first means positioned adjacent the third corrugation roller means for squeezing together the sides of the center corrugation groove to produce a center rib in the metal strip;

second means positioned adjacent the first squeezing means for squeezing together the sides of one of the outer corrugation grooves to produce a first outer rib in the metal strip adjacent and parallel to the center strip rib; and third means positioned adjacent the second squeezing means for squeezing together the sides of the other outer corrugation groove to produce a second outer rib in the metal strip adjacent and parallel to the center strip rib.

5. The improvement of claim 4 wherein the second squeezing means and the third squeezing means are positioned side-by-side and adjacent the first squeezing means to simultaneously produce two outer ribs in the metal strip adjacent and parallel to the center strip rib.

6. The improvement of claim 4 wherein each squeezing means includes a pair of horizontally disposed rollers for squeezing the sides of the corrugation grooves together.

7. The improvement of claim 6 further comprising means for pivotally mounting each squeezing roller.

8. The improvement of claim 7 further comprising means for vertically adjusting each squeezing roller.

9. The improvement of claim 8 further comprising means for horizontally adjusting each squeezing roller.

10. In an apparatus for producing spiral seamed pipe from a metal strip, including a frame, means for feeding the strip through the frame, means for forming the strip into a pipe so that the outer edges of the strip mate, and means for compressing the mated edges to produce a spiral seam, the improvement comprising:

a plurality of edge forming roller means, mounted in the frame, for bending the outer edges of the strip into predetermined shapes;

a first pair of corrugation roller means mounted in the frame after the edge forming roller means and having a center rib and two outer ribs which cooperate with a center groove and two outer grooves for forming three parallel corrugation grooves in the metal strip;

a second pair of corrugation roller means mounted in the frame after the first corrugation roller means and having a center rib and two outer ribs and a center groove and two outer grooves, the ribs and grooves of the second corrugation roller means being narrower than the ribs and grooves of the first corrugation roller means, and the outer ribs and outer grooves of the second corrugation roller means being inwardly displaced relative to the the outer ribs and outer grooves of the first corrugation roller means, the ribs and grooves of the second corrugation roller means corresponding to form the corrugation grooves in the metal strip deeper and narrower;

a third pair of corrugation rollers means mounted in the frame after the second corrugation roller means and having a center rib and two outer ribs and a center groove and two outer grooves, the ribs and grooves of the third corrugation roller means being narrower than the ribs and grooves of the second corrugation roller means, and the outer ribs and outer grooves of the third corrugation roller means being inwardly displaced relative to the the outer ribs and outer grooves of the second corrugation roller means, the ribs and grooves of the third corrugation roller means cooperating to form the corrugation grooves in the metal strip deeper and narrower;

first means, mounted in the frame adjacent the third corrugation rollers means, for squeezing together the sides of the center corrugation groove to produce a center rib in the metal strip; and second means and third means, mounted in the frame adjacent the first squeezing means and positioned side-by-side, for simultaneously squeezing together the sides of the two outer corrugation grooves to produce two outer ribs in the metal strip adjacent and parallel to the center strip rib.

11. The improvement of claim 10 wherein each squeezing means includes a pair of horizontally disposed rollers for squeezing the sides of a corrugation groove together.

12. The improvement of claim 11 further comprising means for pivotally mounting each squeezing roller, means for vertically adjusting each squeezing roller, and means for horizontally adjusting each squeezing roller.

13. The improvement of claim 10 wherein a first pair of the edge forming roller means bends a first edge of the strip downwardly at an angle less than 45° and bends a second edge into a v-shaped channel, and a second pair of the edge forming roller means further bends the first edge downwardly so that it is perpendicular to the strip and bends the outer edge of the v-shaped channel upwardly so that it is perpendicular with respect to the strip.

14. In an apparatus for producing spiral seamed pipe from a metal strip, including a frame, means for feeding the strip through the frame, means for forming the strip into a pipe so that the outer edges of the strip mate, and means for compressing the mated edges together to produce a spiral seam, the improvement comprising:

a pair of alignment rollers mounted in the frame for aligning the strip as it is fed through the frame;

two pair of lockseam forming rollers, mounted in the frame adjacent the alignment rollers for further aligning the strip and for bending the outer edges of the strip to different predetermined shapes, the first lockseam forming roller pair bending the left edge of the strip downwardly to an angle less than 45° and the right edge into a v-shaped channel, the second lockseam forming roller pair further bending the left edge downwardly so that it is perpendicular to the strip and the outer edge of the v-shaped channel upwardly so that it is perpendicular with respect to the strip;

a first corrugation roller pair mounted in the frame adjacent the lockseam forming rollers and having a center rib and two outer ribs on an upper roller which cooperate with a center groove and two outer grooves on a lower roller for forming three parallel corrugation grooves in the metal strip;

a second corrugation roller pair being identical in structure to the first corrugation roller pair and mounted in the frame adjacent to the first corrugation roller pair, the second corrugation rollers having less clearance between their ribs and grooves for forming the corrugation grooves in the metal strip deeper and narrower;

a third corrugation roller pair mounted in the frame adjacent the second corrugation roller pair and having a center rib and two outer ribs on an upper roller and a center groove and two outer grooves on a lower roller, the ribs on the third upper corrugation roller being higher and narrower than the ribs on the second upper corrugation roller, the grooves on the third lower corrugation roller being deeper and narrower than the grooves on the second lower corrugation roller, and the outer ribs and outer grooves on the third corrugation roller pair being displaced inwardly relative to the outer ribs and outer grooves of the second corrugation roller pair, the ribs and grooves on the third corrugation roller pair cooperating to form the corrugation grooves in the metal strip deeper and narrower;

a fourth corrugation roller pair being identical in structure to the third corrugation roller pair and mounted in the frame adjacent to the third corrugation roller pair, the fourth corrugation rollers having less clearance between their ribs and grooves for forming the corrugation grooves in the metal strip deeper and narrower;

a fifth corrugation roller pair mounted in the frame adjacent the fourth corrugation roller pair and having a center rib and two outer ribs on an upper roller and a center groove and two outer grooves on a lower roller, the ribs on the fifth upper corrugation roller being higher and narrower than the ribs on the fourth upper corrugation roller, the grooves on the fifth lower corrugation roller being deeper and narrower than the grooves on the fourth lower corrugation roller, and the outer ribs and outer grooves on the fifth corrugation roller pair being displaced inwardly relative to the the outer ribs and outer grooves of the fourth corrugation roller pair, the ribs and grooves on the fifth corrugation roller pair cooperating to form the corrugation grooves in the metal strip deeper and narrower;

first means, mounted in the frame adjacent the fifth corrugation roller pair, for squeezing together the sides of the center corrugation groove to form a center rib in the metal strip; and second and third means, mounted side-by-side and adjacent the first squeezing means, for simultaneously squeezing together the two outer corrugation grooves to form two outer ribs in the metal strip which are parallel and adjacent to the center strip rib.

15. The improvement of claim 14 wherein each squeezing means includes a pair of horizontally disposed rollers for squeezing the sides of a corrugation groove together, and further comprising means for pivotally mounting each squeezing roller, means for vertically adjusting each squeezing roller, and means for horizontally adjusting each squeezing roller.

* * * * *

UNITED STATES PATENT AND TRADEMARK OFFICE

CERTIFICATE OF CORRECTION

PATENT NO. : 4,567,742

DATED : February 4, 1986

INVENTOR(S) : Wilhelmus P.H. Castricum

It is certified that error appears in the above-identified patent and that said Letters Patent is hereby corrected as shown below:

IN THE BACKGROUND AND
SUMMARY OF THE INVENTION

In column 1, line 26, please delete "strengthing" and substitute therefor --strengthening--;

In column 2, line 8, please delete "expenses" and substitute therefor --expanses--.

IN THE DETAILED DESCRIPTION
OF THE PREFERRED EMBODIMENTS

In column 4, line 5, please delete "therein" and substitute therefor --within--;

In column 6, line 29, please insert a comma (,) after "edges 107";

In column 6, line 30, please insert a comma (,) after "edges 109";

In column 6, line 33, after the words "placed to the" please add the following:

--center of the corrugation rollers relative to the center ribs and grooves--

In column 8, line 63, please delete "roller 78 is" and substitute therefor -- roller 78 in--.

UNITED STATES PATENT AND TRADEMARK OFFICE

CERTIFICATE OF CORRECTION

PATENT NO. : 4,567,742

DATED : February 4, 1986

INVENTOR(S) : Wilhelmus P.H. Castricum

It is certified that error appears in the above-identified patent and that said Letters Patent is hereby corrected as shown below:

IN THE CLAIMS

In Claim 1 (column 11, line 59), please delete the duplicate word "the";

In Claim 1 (column 11, line 67), please delete the duplicate word "the";

In Claim 10 (column 13, line 4), please delete the duplicate word "the";

In Claim 10 (column 13, line 7), please delete "corresponding" and substitute therefor --cooperating--;

In Claim 14 (column 14, line 46, please delete the duplicate word "the".

Signed and Sealed this

Thirteenth Day of September, 1988

*Attest:*

DONALD J. QUIGG

*Attesting Officer*

*Commissioner of Patents and Trademarks*